US005157704A

United States Patent [19]

Harding

[11] Patent Number: 5,157,704

[45] Date of Patent: Oct. 20, 1992

[54] MONOCHROMATIC X-RAY TUBE RADIATION WITH A SCREEN OF HIGH ATOMIC NUMBER FOR HIGHER FLUORESCENT RADIATION OUTPUT

[75] Inventor: Geoffrey Harding, Hamburg, Fed. Rep. of Germany

[73] Assignee: U.S. Philips Corp., New York, N.Y.

[21] Appl. No.: 704,241

[22] Filed: May 22, 1991

[30] Foreign Application Priority Data

May 26, 1990 [DE] Fed. Rep. of Germany ..... 4017002

[51] Int. Cl.[5] ..... H01J 35/00

[52] U.S. Cl. ..... 378/119; 378/143; 378/44; 378/145

[58] Field of Search ..... 378/143, 45, 124, 119, 378/156, 161, 141, 142, 145

[56] References Cited

U.S. PATENT DOCUMENTS

| | | | |
|---|---|---|---|
| 3,567,928 | 3/1971 | Davies et al. | 378/45 |
| 3,920,999 | 11/1975 | Drexler et al. | 378/119 |
| 3,963,922 | 6/1976 | Zulliger et al. | 378/45 |
| 4,903,287 | 2/1990 | Harding | 378/119 |

FOREIGN PATENT DOCUMENTS 3716618 11/1988 Fed. Rep. of Germany .

*Primary Examiner*—Janice A. Howell
*Assistant Examiner*—Kim-Kwok Chu
*Attorney, Agent, or Firm*—Jack D. Slobod

[57] ABSTRACT

A monochromatic X-ray radiation source includes an anode for producing X-ray radiation, a target enclosed by the anode for converting X-ray radiation into fluorescence radiation and a screen located between the target and the anode for screen the target from electrons. A higher output of fluorescence radiation is attained in that the screen comprises an element having an atomic number greater than 50, for example, tungsten or tantalum.

13 Claims, 1 Drawing Sheet

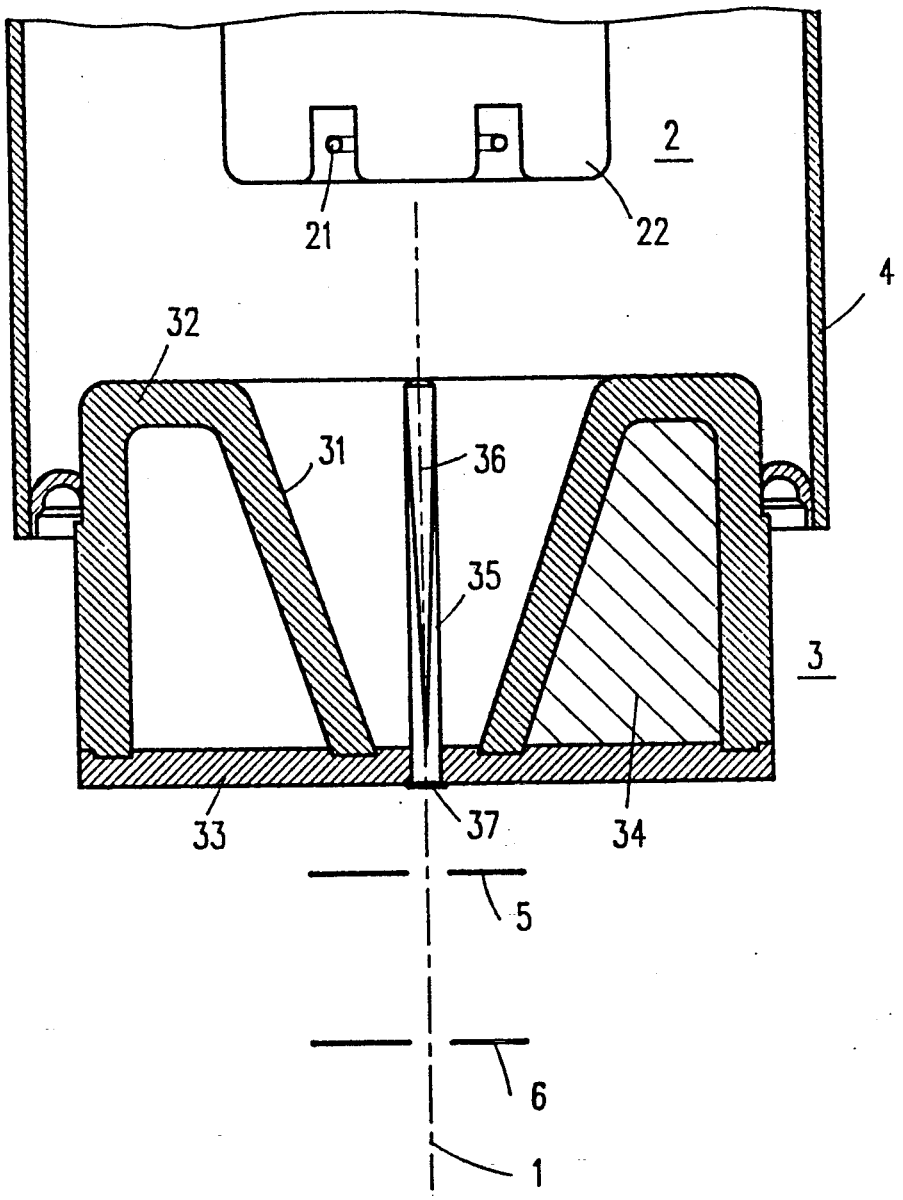
2
21
22
4
32
31
36
35
3
33
37
34
5
6
1

MONOCHROMATIC X-RAY TUBE RADIATION WITH A SCREEN OF HIGH ATOMIC NUMBER FOR HIGHER FLUORESCENT RADIATION OUTPUT

FIELD OF THE INVENTION

The invention relates to a radiation source for producing a substantially monochromatic X-ray radiation comprising an anode for producing X-ray radiation, a target enclosed by the anode for converting X-ray radiation into florescence radiation and a screen located between the target and the anode for screening the target from electrons.

BACKGROUND OF THE INVENTION

Such a radiation source is known from DE-OS 37 16 618 which corresponds to U.S. Pat. No. 4,903,287. The disclosed metal screen serves to keep (scattered) electrons remote from the target, which would lead to polychromatic stray radiation being produced in the target besides the substantially monochromatic fluorescence radiation. This screen is traversed by the X-ray radiation emitted by the anode and converted in the target into fluorescence radiation. In order to avoid that the screen absorbs an excessive quantity of X-ray radiation and on the other hand itself emits due to scattered or secondary electrons (polychromatic) X-ray radiation, the screen is as thin-walled as possible and consists of a low-atomic material (for example titanium (with a target of tantalum)).

SUMMARY OF THE INVENTION

The invention has for its object to construct a radiation source of the kind mentioned in the opening paragraph in such a manner that even more fluorescence radiation or monochromatic X-ray radiation can be produced. According to the invention, this object is achieved in that the screen comprises an element having a high atomic number.

The invention is based on the recognition of the fact that a screen comprising an element having a high atomic number (the term "high" in accordance with the invention is to be understood to mean an atomic number, whose deviation from the atomic number of the target material is small as compared with the relevant atomic number) in the periodical system of elements, absorbs more X-ray radiation from the anode than a screen of the same strength consisting of a low-atomic element. The stray radiation produced by the screen comprising an element having a high atomic number is converted in the target mainly into fluorescence radiation. Thus, the output of fluorescence radiation in all can be increased.

A further preferred embodiment of the invention ensures that the screen and the target comprise the same element having a high atomic number. In a still further embodiment of the invention, the screen and the target consist of tantalum. The advantage of the further embodiment consists in that the thermal expansion of the target and the screen is the same in both cases so that a heating cannot lead to mechanical stresses and in that the spectral purity of the spectrum produced is deteriorated to the smallest possible extent because the characteristic radiation produced in the screen has the same wavelength as the fluorescence radiation produced in the target. With the use of tantalum as material for the target and the screen, the high melting point of this material is an additional effect so that the radiation source can be acted upon by a considerably higher electrical power than is possible in the known radiation source comprising a screen of titanium.

In a still further embodiment of the invention, the radiation source comprises an envelope, which encloses a space which is evacuated in the operating condition and in which the anode, the screen and the target are located. While in the known radiation source the screen seals the radiation source in a vacuum-tight manner so that the target and the surface facing it come into contact with the atmospheric oxygen, the target and this screen surface, respectively, are located in this further embodiment within the vacuum space of the radiation source. The screen and the target are therefore more capable of withstanding high temperatures.

In a further embodiment of the invention, a collimator is constructed so that only the radiation originating from the target can pass the collimator. As a result, the stray radiation produced in the screen is suppressed to the greatest possible extent.

The sole drawing FIGURE shows an embodiment of the invention, which will be described more fully hereinafter. The radiation source made rotation-symmetrical with respect to an axis 1 comprises a cathode 2 and an anode 3, which are connected to each other in a vacuum-tight manner through an envelope 4. The cathode 2 is connected through an isolator (not shown) to the envelope 4 consisting of metal and has a voltage with respect thereto of, for example, 160 kV or higher. The cathode comprises a ring-like heating wire 21 enclosing the axis of symmetry 1 and an electron beam shaper 22 which shapes the paths of the electrons emitted from the heating wire 21 in the desired manner.

The anode 3 comprises a hollow body, comprising two parts 32 and 33 secured together and whose cavity is traversed in the operating condition by an externally supplied liquid cooling agent supplied in a manner not shown. Part 33 is disc shaped having a central bore. A separation wall 34 prevents the cooling agent from flowing along the shortest path from the coolant inlet to the coolant outlet (both not shown). The parts 32 and 33 of the anode body may consist, for example, of copper. The part 32 of the anode body has an inner surface 31 opened towards the cathode 2 and having the form of a generated surface of a truncated cone. This generated surface 31 is coated with a material having a high atomic number, preferably gold. The electrons emitted from the heating wire 21 in the operating condition strike inner surface 31. This surface is therefore also designated hereinafter as "anode". The electrons striking the anode 31 produce X-ray radiation having a spectrum continuous up to a quantum energy determined by the voltage between the anode and the cathode and on this spectrum is superimposed the line spectrum of gold with a K line at approximately 68.8 keV.

The X-ray radiation strikes through a thin cylindrical screen 35 to a target 36 of tantalum, which has the form of a cone, whose tip points away from the cathode 2. The target converts X-ray quanta having an energy above the K absorption edge of the target (for tantalum approximately 67.4 keV) in the target substantially into monochromatic fluorescence radiation, whose quantum energy corresponds to the characteristic energy of the target material (for tantalum: 57.5 keV).

The screen 35, which carries the target 36, is secured in the central bore in the disk-shaped part 33 of the anode 3 and which screen is sealed in a vacuum-tight manner to part 33 by a window 37.

In practice, it is inevitable that a portion of the electrons emitted from the wire 21 are accelerated towards the target 36—preferably after having been scattered by the anode 31. If these electrons should strike the target 36, they would cause there additionally an undesired continuous spectrum. The screen 35 must therefore keep these electrons remote from the target 36.

The invention utilizes the fact that the electrons strike the screen 35 to produce additional X-ray radiation. For this purpose, the screen must consist of an element having a high atomic number or must comprise such an element to a sufficient extent. The atomic number of this element should at any rate be slightly lower than that of the target, but should exceed 50 as far as possible. The electron bombardment of the screen 35 produces besides characteristic radiation polychromatic, stray radiation. Of this radiation a substantially larger part strikes the target than of the radiation of the anode because the screen tightly encloses the target.

An element suitable because it has a high atomic number (74) and a high thermal load capacity is, for example, tungsten. In the case of a tantalum target, however, a screen likewise of tantalum is even more favorable than a screen of tungsten. The quantum energy of the characteristic radiation of tungsten is in fact about 2 keV higher than that of tantalum. Even if it should be prevented that the X-ray radiation emitted by the screen directly passes to the outside, it cannot be prevented that this radiation causes at the target 36 elastic or Compton scattering processes and, thus, passes to the outside and adversely affects the spectral purity of the radiation. If, in contrast, the target and the screen consist of the same material (tantalum), these problems do not arise so that with a target of tantalum a screen of tantalum yields a higher spectral purity of the radiation emitted by the target than a screen of tungsten. A further additional advantage is that in this case the screen and the target also have the same thermal coefficient of expansion, which is important at the high temperatures to which these parts are subjected during operation.

The screen 35 must be sufficiently thick to keep the scattered electrons remote from the target 36, but must also be sufficiently thin not to attenuate excessively the radiation emitted by the anode 31. A suitable value for the wall thickness of the screen is 0.1 mm. Although this screen absorbs more X-ray radiation than a screen of titanium having the same thickness, because of the additionally produced X-ray radiation a higher emission of quasi monochromatic radiation by the target 36 is obtained than with a screen of titanium having the same wall thickness.

Although the number of the electrons striking the anode 31 exceeds by a factor of about 10 the number of the scattered electrons striking the screen 35 and, although the energy of the first-mentioned electrons on an average is larger than that of the scattered electrons, the screen becomes considerably hotter than the anode body during operation on due its smaller surface area and wall thickness and due to the failing cooling. The electrical power that can be supplied to the radiation source is therefore limited by the temperature resistance of the screen 35, i.e., its resistance to destruction by heating. In this respect, a screen of tantalum is also preferred to a screen of titanium on account of its considerably higher melting point. In conjunction with the materially improved conversion of the electrical power into fluorescence radiation, this results in that the intensity of the quasi monochromatic radiation can be a multiple larger than with a radiation source having a screen of titanium.

In order to be able to utilize the high thermal load capacity of the parts of tantalum, it must be avoided that the parts of tantalum come into contact with the atmospheric oxygen. Therefore, the screen 35 must not seal the radiation source to the outside in a vacuum-tight manner—as disclosed in U.S. Pat. No. 4,903,287 , but must be provided with one or more small openings (not shown) so that the vacuum prevailing in the interior of the envelope 4 also prevails in the inner space of the screen 35.

The central bore, into which the screen 35 is inserted, is sealed to the outside by the radiation transmission window 37. The radiation transmission window is formed by a small plate, which may also consist of tantalum. Due to material equality between the target 36 and the radiation window, the absorption coefficient of the radiation transmission window is comparatively small for the fluorescence radiation produced in the target.

The radiation transmission window 37 is preceded by a diaphragm arrangement, which consists, for example of two pinhole diaphragms 5, 6 and is connected to the radiation source in a manner not shown. The openings in this diaphragm arrangement are dimensioned so that the X-ray radiation, which is produced in the screen 35 and emanates directly via window 37, is suppressed by the diaphragm arrangement to a great extent. Thus, it is prevented that the continuous spectrum of the radiation produced in the screen adversely affects the spectral purity of the fluorescence radiation, which traverses the diaphragm arrangement. This diaphragm arrangement preferably consists of the same material as the target 36 and the window 37—in the example therefore of tantalum.

What is claimed is:

1. A radiation source for producing a substantially monochromatic X-ray radiation comprising an anode for producing X-ray radiation, a target surrounded by the anode for converting the X-ray radiation into fluorescence radiation and a screen located between the target and the anode for inhibiting scattered electrons from impinging on the target, said screen comprising an element having an atomic number sufficiently high to convert the scattered electrons incident thereon to X-rays.

2. A radiation source as claimed in claim 1 wherein the screen and the target each comprise the same material.

3. A radiation source as claimed in claim 2 wherein the screen and the target consist of tantalum.

4. A radiation source as claimed in claim 1 further including an envelope, which encloses a space which is evacuated in the operation condition and in which the anode, the screen and the target are located.

5. A radiation source as claimed in claim 4 wherein the envelope is sealed by a window for transmitting radiation emitted by the target.

6. A radiation source as claimed in claim 5 wherein the window is of the same material as the target.

7. A radiation source as claimed in claim 1 further including a collimator which is of the same material as the target and is constructed so that only the radiation originating from the target can pass the collimator.

8. A radiation source as claimed in claim 3 further including an envelope, which encloses a space which is evacuated and, in which the anode, the screen and the target are located.

9. A radiation source as claimed in claim 8 wherein the envelope is sealed by a window for transmitting radiation emitted by the target.

10. A radiation source as claimed in claim 9 wherein the window is of the same material as the target.

11. A radiation source as claimed in claim 10 further including a collimator which is of the same material as the target and is constructed so that only the radiation originating from the target can pass the collimator.

12. A radiation source as claimed in claim 6 further including a collimator which is of the same material as the target and is constructed so that only the radiation originating from the target can pass the collimator.

13. A radiation source as claimed in claim 2 further including a collimator which is of the same material as the target and is constructed so that only the radiation originating from the target can pass the collimator.

* * * * *